US006284332B1

(12) United States Patent
Buettner et al.

(10) Patent No.: US 6,284,332 B1
(45) Date of Patent: Sep. 4, 2001

(54) EXHAUST LINE OF AN EXHAUST SYSTEM EQUIPPED WITH A CATALYTIC CONVERTER FOR AN INTERNAL COMBUSTION ENGINE

(75) Inventors: Ulrich Buettner, Senden; Marin Hartweg, Erbach; Herbert Klein, Leutenbach; Martin Matt, Bruchsal; Wolfram Muench, Mannheim; Karl-Heinz Thiemann, Korb; Reinhard Zachai, Guenzburg, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/148,543

(22) Filed: Sep. 4, 1998

(30) Foreign Application Priority Data

Sep. 4, 1997 (DE) ..... 197 386 22

(51) Int. Cl.[7] ..... F16L 9/10

(52) U.S. Cl. ..... 428/34.4; 428/34.6; 428/36.91; 428/469; 138/145; 138/146; 123/434; 60/273

(58) Field of Search ..... 428/35.7, 36.91, 428/34.4, 34.5, 34.6, 34.7, 36.92, 469, 470, 688, 36.9, 36.4; 138/145, 146, 143; 123/434; 60/273

(56) References Cited

U.S. PATENT DOCUMENTS

| | | | |
|---|---|---|---|
| 4,526,824 | 7/1985 | Dworak et al. | 428/35 |
| 4,950,627 | 8/1990 | Tokarz et al. | 501/95 |
| 5,018,661 | 5/1991 | Cyb | 228/176 |
| 5,167,988 | 12/1992 | Yano et al. | 428/35.1 |

FOREIGN PATENT DOCUMENTS

| | | |
|---|---|---|
| WO 80/02439 | 11/1980 | (EP) . |
| 0 352 246 A2 | 1/1990 | (EP) . |
| 62-211138 | 9/1987 | (JP) . |
| 3-106553 | 5/1991 | (JP) . |
| 6-145561 | 5/1994 | (JP) . |

*Primary Examiner*—Rena L. Dye
(74) *Attorney, Agent, or Firm*—Crowell & Moring LLP

(57) ABSTRACT

An exhaust line for an exhaust system of an internal combustion engine having a catalytic converter, the exhaust line being located upstream of the catalytic converter with respect to the flow direction of exhaust. The exhaust line has an externally applied heat-conducting layer preferably made of a metallic material and an internally disposed insulating layer made of a heat-insulating material. The insulating layer and the heat-conducting layer are connected directly and forcewise with one another. The layer thickness of the insulating layer is less than 2 mm, the specific heat capacity c of the insulating layer is less than $10^6$ J/($m^3$h), and the heat diffusivity κ of the insulating layer is less than 0.01 $cm^2$/s.

10 Claims, 2 Drawing Sheets

EXHAUST LINE OF AN EXHAUST SYSTEM EQUIPPED WITH A CATALYTIC CONVERTER FOR AN INTERNAL COMBUSTION ENGINE

BACKGROUND AND SUMMARY OF THE INVENTION

This application claims the priority of German Patent No. 197 386 22.9, filed Sep. 4, 1997, the disclosure of which is expressly incorporated by reference herein.

The invention relates to an exhaust line for an internal combustion engine exhaust system having a catalytic converter.

An exhaust manifold is known from DE 40 39 735 A1 whose wall is made of three layers in cross section. The advantage of this exhaust manifold consists in the fact that the response time of a catalytic converter located downstream is shortened and total pollutant emissions reduced.

The exhaust manifold has an externally located metal pipe made especially from a stainless steel. Internally the wall has a damping layer connected forcewise with the pipe. The damping layer is composed of a foil and an insulating layer that coats and heat-insulates the foil. The foil is in direct contact with exhaust, while the insulating layer forms an intermediate layer between the external pipe and the internal foil of the exhaust manifold. The foil is made of a material that is resistant to heat and scale and has a layer thickness of less than 0.5 mm and especially 0.2 mm. The insulating layer consists of a high-strength and asbestos-free heat-damping material, for example a ceramic fiber made of $SiO_2$, and has a layer thickness between 2 mm and 4 mm. The layer thickness of the damping layer composed of the insulating layer and the foil is therefore between 2.2 mm and 4.5 mm. The forcewise connection between the damping layer and the tube takes place along individual spot and/or linear welds between the foil and the pipe so that the insulating layer in the ideal case is clamped between the foil, the pipe and the individual spot and/or linear connections.

To line the pipe, the damping layer is initially shaped into a tubular, flexible, hollow body and folded at least once in the lengthwise direction, with the mass of the hollow body corresponding to that which it later has in the exhaust manifold. The folded hollow body is introduced into the outer pipe and applied free of folds to the inside wall of the outer pipe by a mechanical and/or hydraulic widening process. The manufacture of the previously known exhaust manifold therefore involves several successive worksteps and is therefore time-consuming, complex, and expensive. Furthermore the inside cross section of the outer pipe is reduced by at least 4.4 mm, so that the outside diameter of the outer pipe must be correspondingly large, involving increased weight, increased material consumption, and a greater consumption of space. This also has a negative effect on manufacturing costs.

A collecting pipe for exhaust is known from DE-OS 24 48 482 with a plurality of stubs that lead to the cylinders of an internal combustion engine. The collecting pipe and stubs are provided internally with an insulating layer that consists of several prefabricated and appropriately shaped individual pieces. The individual pieces are introduced into the collecting pipe and into the stubs, with the individual pieces located in the stubs engaging suitably shaped recesses that engage the individual pieces of the collecting pipe and hold these individual parts of the collecting pipe. In this case also, the manufacture of this exhaust pipe that consists of the collecting pipe involves a considerable space requirement in addition to being costly and tedious.

An outlet duct located in the cylinder head is known from U.S. Pat. No. 4,526,824, the duct constituting the exhaust line and having a heat-insulating inserted bushing on portions of its inside wall. The inserted bushing has an insulating layer of fibers facing the cylinder head and also has a sintered body made of heat- and scale-resistant aluminum titanate facing the exhaust. To produce the outlet duct, that is the exhaust line, the prefabricated bushing is defined in terms of position before the cylinder head is cast in its mold and is largely inserted in a fixed position, and the cylinder head is then cast. Since the fixed mounting in the casting mold involves tolerances, some of which are considerable, the outlet duct must at least be checked after casting and finished as necessary. For these reasons among others, this type of manufacture is likewise tedious and expensive.

A muffler is known from EP 27 009 which is provided internally at least area wise with an enamel layer for noise damping. In addition, various methods for applying the enamel layer are known from EP 27 009 as well as various physical designs for the surface of the muffler for improved adhesion of the enamel layer.

Finally, there is air gap insulation in which the exhaust manifold is made from an inner pipe and an outer pipe located concentrically with respect to one another and spaced apart from one another in a heat-insulating fashion by an air gap. Air gap insulation is likewise very cumbersome and expensive.

An object of the present invention is to provide an improved exhaust line so that with a comparable reduction of total pollutant emissions, the manufacture of the exhaust line is simplified and made as inexpensive as possible.

This object has been achieved by an exhaust line with a heat-conducting layer and an insulating layer connected directly and forcewise with the heat-conducting layer, the insulating layer having a thickness of less than 2 mm, having a specific heat capacity of less than $10^6$ J/($m^3$h) and having a thermal diffusivity of k of less than 0.01 cm $^2$/s. Surprisingly, despite the fact that the very thin insulating layer can be applied internally both simply and economically, the exhaust line is adequately heat-insulated. Since the layer thickness of the insulating layer is also thin, the flow cross section is advantageously not affected adversely.

BRIEF DESCRIPTION OF THE DRAWINGS

Other objects, advantages and novel features of the present invention will become apparent from the following detailed description of the invention when considered in conjunction with the accompanying drawings, wherein.

DETAILED DESCRIPTION OF THE DRAWINGS

Figure 1:
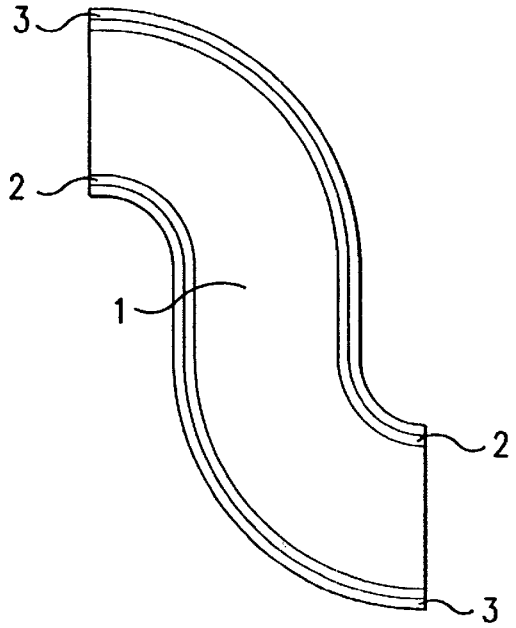
FIG. 1 is a sectional view through an exhaust manifold of an exhaust line in accordance with the present invention.

FIG. 1 shows an S-shaped exhaust manifold of an exhaust line for an exhaust system of an internal combustion engine that has a catalytic converter, especially for a motor of a motor vehicle. Although only exhaust manifold 1 of the exhaust line is discussed in this embodiment, the invention can be transferred to all areas of the exhaust line located upstream of the catalytic converter, namely, beginning with the cylinder head, the exhaust duct, the collector stubs located downstream from the outlet duct, the collector itself, and the exhaust manifold 1.

Exhaust manifold 1 is located near the engine, upstream of the catalytic converter with respect to flow direction of the exhaust. It has an outer pipe which is made as a heat-conducting layer 3 from a metallic material, with the material advantageously being at least largely resistant to rust. The inside wall of the pipe is coated with an insulating layer 2 preferably made of enamel and/or ceramic and/or an anodic oxide layer. The specific heat capacity c of insulating layer 2 is less than $10^6$ J/($m^3$h) whose thermal diffusivity κ is less than 0.001 $cm^2$/s and whose layer thickness is between 2 and 0.1 mm.

Insulating layer 2 and the metal of heat-conducting layer 3 are connected directly and forcewise with one another, with the inner surface of insulating layer 2 in direct contact with the exhaust.

In order for the stress caused by different coefficients of thermal expansion of heat-conducting layer 3 and insulating layer 2 to be reduced, insulating layer 2 is advantageously applied with a predetermined layer thickness between 100 μm and 500 μm. It is also advisable to make insulating layer 2 with several thin points at which the layer thickness is reduced by at least 10%, preferably at least by 50%, and especially preferably by at least 90%.

Figure 3:
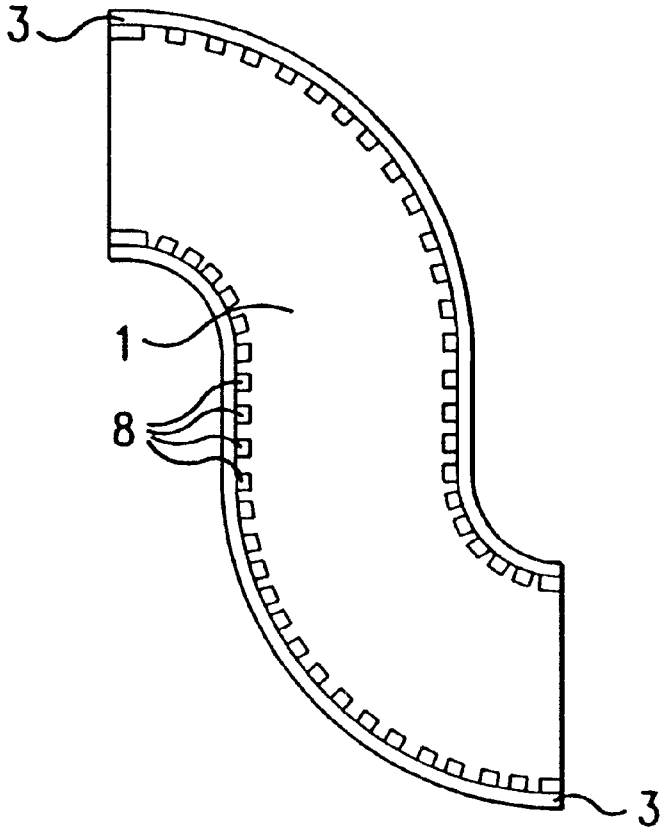
FIG. 3 is a sectional view through an exhaust manifold of an exhaust line in accordance with the present invention.

In one special embodiment, as shown in FIG. 3, insulating layer is formed by several material islands 8 separated spatially from one another, which in turn can be provided with the above thin points. By these measures, a layer with properties can be produced from a brittle material such as enamel that in general is like a layer made of elastic material.

Figure 2:
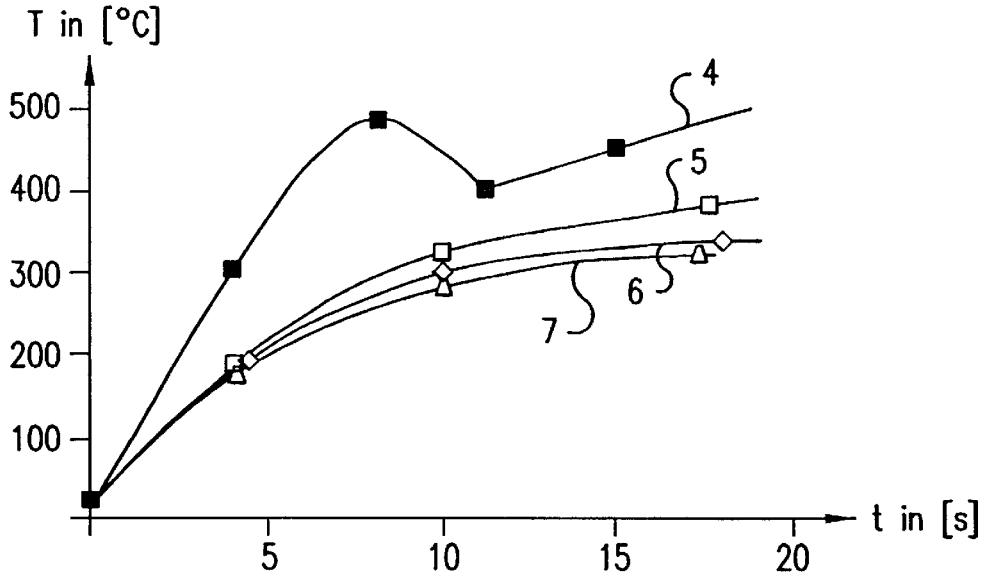
FIG. 2 is a graph showing exhaust temperature as a function of time.

FIG. 2 shows a graph of exhaust temperature in an exhaust line as a function of time, with time at $t_0$=0 taken as the time the engine is started. The individual curves 4 to 7 in the graph in FIG. 2 individually describe the following in detail:

Curve 4 shows exhaust temperature at the cylinder outlet, that is before the exhaust enters the exhaust manifold.

Curve 5 shows exhaust temperature at the inlet of the catalytic converter, that is downstream from exhaust manifold 1, with exhaust manifold 1 being coated internally with an insulating layer 2 made of enamel, whose layer thickness is 0.5 mm (500 μm) and whose thermal diffusivity κ is 0.007 $cm^2$/s.

Curve 6 shows exhaust temperature at the inlet of the catalytic converter, that is downstream from exhaust manifold 1, with exhaust manifold 1 having an air-gap insulation; and Curve 7 shows the temperature of exhaust at the inlet of the catalytic converter with a normal exhaust manifold 1 without any kind of insulating layer 2.

As can be seen from the graph in FIG. 2, the temperature of exhaust at the catalytic converter with thin insulating layer 2 is highest. As a result, the catalytic converter warms up to operating temperature fastest so that pollutant emissions during the starting phase, and hence total emissions as well, are reduced.

Application of an enamel layer, as well as priming when applying enamel, can be found for example in EP 27 809. In addition, plasma-CVD be used to apply the insulating and especially the enamel layer among others.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Exhaust line for an internal combustion engine exhaust arrangement with a catalytic converter, which exhaust line, as viewed in a flow direction of an exhaust gas from an internal combustion engine, located upstream of the catalytic converter, adjacent to the engine, and the exhaust line having an externally located heat-conducting layer comprising a metallic material and a beat-insulating material layer internally located on the heat conducting layer, the heat-insulating layer and the heat-conducting layer being connected forcewise with another, wherein the heat-insulating layer and the heat-conducting layer are directly connected with one another, the heat-insulating layer is located inwardly of the exhaust line, the heat-insulating layer with a predetermined layer thickness is arranged to be in direct contact with the exhaust gas, the heat-insulating layer is configured to include a plurality of thin areas having a thickness reduced by at least about 10% from the predetermined layer thickness to less than about 2 mm, whereby the thermal conductivity of the heat-insulating layer is less than about $10^6$ J/($m^3$h), and the thermal diffusivity of the heat-insulating layer is sized to be less than about 0,01 $cm^2$/s.

2. The exhaust line according to claim 1, wherein the thickness of the insulating layer is more than 100 μm.

3. The exhaust line according to claim 1, wherein the thickness of the insulating layer is less than 1 mm.

4. The exhaust line according to claim 3, wherein the thickness of the heat insulating layer is less than 500 μm.

5. The exhaust line according to claim 3, wherein the thickness of the head insulating layer is less than 300 μm.

6. The exhaust line according to claim 1, wherein the thickness of the plurality of thin areas is reduced by at least 50% from the predetermined layer thickness.

7. The exhaust line according to claim 1, wherein the thickness of the plurality of thin areas is reduced by at least 90% from the predetermined layer thickness.

8. The exhaust line according to claim 1, wherein the heat-insulating layer is configured to be in the form of a plurality of spatially separated islands.

9. The exhaust line according to claim 1, wherein the heat insulating layer is made of at least one material selected from the group consisting of enamel, ceramic and an anodic oxide.

10. A method for treating exhaust gas, from an internal combustion engine, comprising:

(a) flowing said exhaust gas through an exhaust line, for an exhaust system having a catalytic converter, the exhaust line as viewed in a flow direction of exhaust gas from an internal combustion engine, being located upstream of the catalytic converter, adjacent to the engine, and having an externally located heat-conducting layer comprising a metallic material and a heat-insulating material layer internally located on the heat conducting layer, the heat-insulating layer and the heat-conducting layer being connected forcewise with another, wherein the heat-insulating layer and the heat-conducting layer are directly connected with one another, the heat-insulating layer is located inwardly of the exhaust pipe, the heat-insulating layer is arranged to be in direct contact with the exhaust gas, the heat-insulating layer is configured to have plural thin areas having a thickness reduced by at least about 10% from layer thickness of less than about 2 mm, whereby the thermal conductivity of the heat-insulating layer is sized to be less than about $10^6$ J/($m^3$h), and the thermal diffusivity of the heat-insulating layer is sized to be less than about 0.01 $cm^2$/s, and (b) flowing said exhaust gas through a catalytic converter connected to the exhaust line downstream with respect to exhaust flow.

* * * * *